United States Patent [19]

Sagawa

[11] Patent Number: 5,067,913

[45] Date of Patent: Nov. 26, 1991

[54] ELECTRICAL CONNECTOR

[75] Inventor: Tetsuya Sagawa, Yamato, Japan

[73] Assignee: AMP Incorporated, Harrisburg, Pa.

[21] Appl. No.: 525,524

[22] Filed: May 18, 1990

Related U.S. Application Data

[63] Continuation of PCT/US89/03447, Aug. 14, 1989.

[30] Foreign Application Priority Data

Sep. 20, 1988 [JP] Japan ..... 63-235347

[51] Int. Cl.[5] ..... H01R 13/40

[52] U.S. Cl. ..... 439/595; 439/752

[58] Field of Search ..... 439/594, 595, 596, 597, 439/744, 745, 752

[56] References Cited

U.S. PATENT DOCUMENTS 3,337,836 8/1967 Churla ..... 439/595 X
3,982,805 9/1976 Irie ..... 439/595
4,660,915 4/1987 Mantlik ..... 439/595
4,711,509 12/1987 Cross et al. ..... 439/595 X
4,721,482 1/1988 Fukuda et al. ..... 439/595

*Primary Examiner*—Neil Abrams
*Assistant Examiner*—Khiem Nguyen
*Attorney, Agent, or Firm*—Adrian J. LaRue; Allan B. Osborne

[57] ABSTRACT

An electrical connector comprises tab contacts (14) crimped to electrical wires (24) retained in cavities (13) of a dielectric housing (12) with tab sections (14*a*) of the tab contacts (14) extending from the front ends of the cavities (13), and restraining sections (31) are located at the edges of the front ends of the walls of the cavities (13) and extending in the radial direction of the cavities (13) engaging the tab sections (14*a*) along surfaces thereof adjacent the base portions thereof to straighten the tab sections (14*a*) if they have been bent upwardly.

3 Claims, 2 Drawing Sheets

ELECTRICAL CONNECTOR

This is a continuation of International Application PCT/US89/03447 filed Aug 14, 1989, and which designated the United States.

FIELD OF THE INVENTION

The present invention relates to an electrical connector, move specifically to means to prevent tab electrical contacts and receptacle electrical contacts from striking or overriding one another when mating connectors are to be mated.

BACKGROUND OF THE INVENTION

Conventional electrical connectors comprise a cap housing for retaining one or more tab electrical contacts and a plug housing for retaining one or more receptacle electrical contacts. Such cap housing is mated with the plug housing to make electrical connections by inserting tab sections of the tab electrical contacts into receptacle sections of the receptacle electrical contacts.

The tab electrical contacts and receptacle electrical contacts of the electrical connectors are normally made by stamping and forming an electrically-conductive metal sheet. Each tab electrical contact has a tab section and a wire-crimping connection section. The tab electrical contacts are inserted into the housing cavities and retained therein with the tab sections extending from a front surface of the housing cavities. On the other hand, each receptacle electrical contact comprises a so-called box-type receptacle section to receive and engage with the tab section of the tab contact and a wire-crimping section. These two sections are completely inserted and retained in the plug housing.

Now, the electrical wire-crimping connection of the tab electrical contacts is made by using a crimping tool known as an application tool. Such tab section tends to be bent up to form a so-called "bent-up" portion from the central part of the crimping connection during the above-mentioned wire-crimping operation.

However, existing cap housings to retain the inserted tab electrical contacts are not provided with means to correct the aforementioned "bent-up" condition, therefore the tab electrical contacts are inserted and retained in the cap housing without correcting the "bent-up" condition.

When such "bent-up" tab sections are to be inserted in the receptacle sections of the receptacle contacts for making electrical connection therebetween by mating the cap housing, which retains such tab electrical contacts, with the plug housing, which retains such receptacle electrical contacts, there are instances where front ends of the tab sections of the tab contacts are not properly aligned with the receptacle sections of the receptacle contacts, thereby striking against front edges of the receptacle sections and making improper electrical connection by some of the tab sections overriding the front ends of the receptacle sections.

It is, therefore, an object of the present invention to provide an electrical connector to solve the aforementioned problem by providing means to restrain the base portions of the tab sections in the radial direction of the cavities at the front ends thereof while the tab contacts are retained in the housing, thereby correcting the "bent-up" portions of the tab contacts.

SUMMARY OF THE INVENTION

In the present invention intended to achieve the above object, one of the mating connectors has tab contacts to be crimped to electrical wires and retained in cavities of a cap housing while the other electrical connector has receptacle contacts to receive the tab contacts in electrical contact relationship and to be retained in the cavities of a plug housing.

The tab sections of the tab contacts in the one electrical connector extend through the front ends of the cavities of the other electrical connector.

The one electrical connector has restraining sections at the upper edges of the cavities extending in their radial direction to engage with the tab sections adjacent to their base portions.

The restraining sections preferably extend forwardly from the front ends of the cavities.

According to the present invention as implemented above, the restraining sections press the tab sections of the tab contacts at their base portions in the radial direction of the cavities if there exists "bent-up" ends of the tab sections of the tab contacts. As a result, the "bent-up" ends of the tab sections are corrected to their normal condition before being inserted into the receptacle sections, thereby avoiding such "bent-up" ends striking against the receptacle sections of the receptacle contacts or overriding the front ends of the receptacle sections.

An embodiment of the present invention will be described in detail hereunder by way of example with reference to the accompanying drawings.

DESCRIPTION OF THE INVENTION

Figure 1:
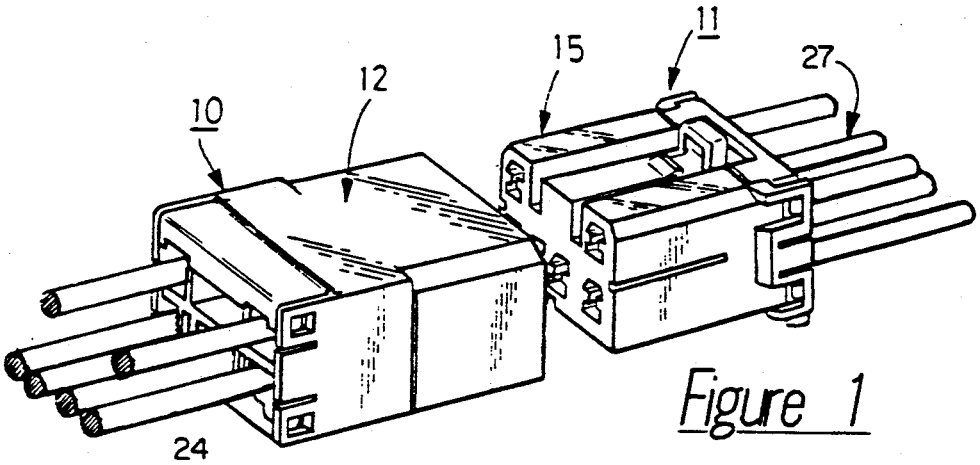
FIG. 1 is a perspective view of mating tab and receptacle connectors of the present invention with the two connectors separated.
Figure 2:
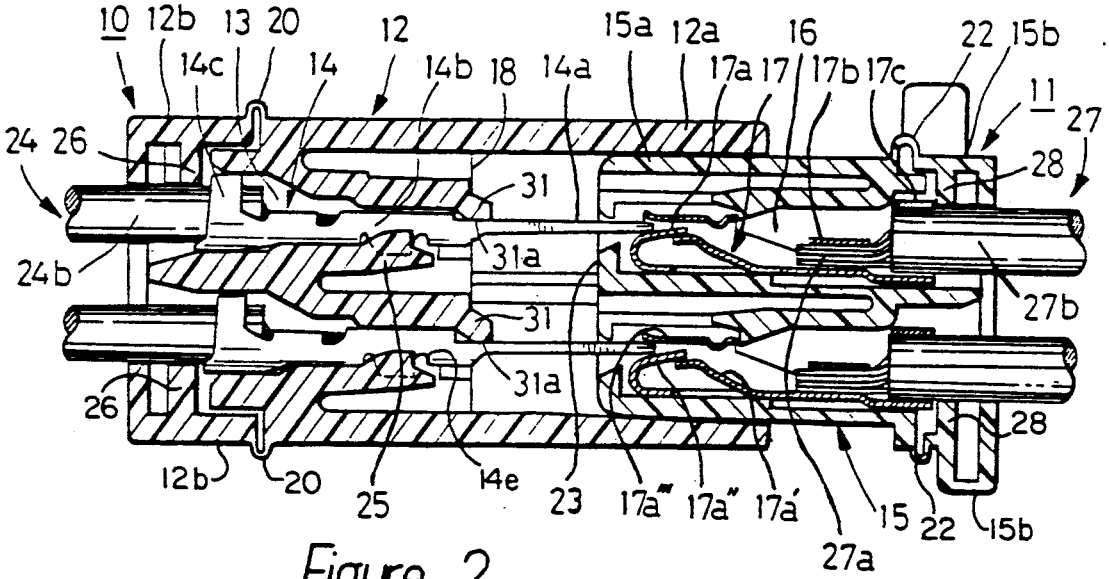
FIG. 2 is a longitudinal cross-sectional view of the connectors in a half-mated condition.

FIGS. 1 and 2 show mating connectors, i.e., tab connector 10 and receptacle connector 11. Tab connector 10 comprises cap housing 12 made of an electrically-insulative material and a plurality of tab contacts 14 inserted and retained in cavities 13 disposed in both vertical and horizontal rows. Receptacle connector 11 comprises receptacle housing 15 made of an electrically-insulative material and a plurality of receptacle contacts 17 inserted and retained in cavities 16 disposed in both vertical and horizontal rows. Cap housing 12 has mating section **12*a* extending forwardly from front surface 18 at which the front ends of cavities 13 are located and back sections 12*b* coupled to mating section 12*a* by way of integral hinges 20. Plug housing 15 has mating section 15*a* to be inserted in mating section 12*a* and back sections 15*b* coupled thereto by way of integral hinges 22**.

Such housings 12 and 15, cavities 13 and 16 and contacts 14 and 17 may take any conventional design and are not described in detail herein. Tab contacts 14 (see FIG. 3) are made of an electrically-conductive metal sheet by a conventional stamping and forming technique and each comprises tab section **14*a*, crimping-connection section 14*b* crimped to a stripped section 24*a* of electric wire 24, insulation-clamping section 14*c* clamped onto electric wire 24 at insulation area 24*b* and projections 14*d***. Formed in the radial direction of cavities 13 are housing lances 25 that are positioned between projections 14*d* to engage with shoulders 14*e* of contacts 14 and projections 26 of back sections 12*b* for engagement with sections 14*c*, thereby limiting back and forth movement of tab contacts 14 in cavities 13.

Each receptacle contact 17 is made of an electrically-conductive metal sheet by a conventional stamping and forming technique and comprises a so-called box-type receptacle section 17*a*, crimping-connection section 17*b* crimped to a stripped portion 27*a* of electric wire 27 and insulation-clamping section 17*c* clamped onto insulation portion 27*b* of electric wire 27. Receptacle section 17*a* comprises resilient member 17*a*' raised from a bottom wall with a slope at the center of the bottom wall, arcuate resilient member 17*a*" extending from the front end of the bottom wall towards the back, and leaf member 17"' wrapping both resilient members 17*a*', 17*a*" therein from both sides of the bottom wall in a sleeve shape. Housing lances 23 and projections 28 of housing 15 extend into each cavity 16 for engagement with receptacle sections 17*a* and clamping sections 17*c* of receptacle contacts 17 to limit back and forth movement of receptacle contacts 17 in cavities 16. Each tab section 14*a* of tab contact 14 is inserted between member 17*a*" and leaf member 17*a*"' of receptacle section 17*a* and due to the resiliency thereof thereby making electrical contact therebetween.

Figure 3:
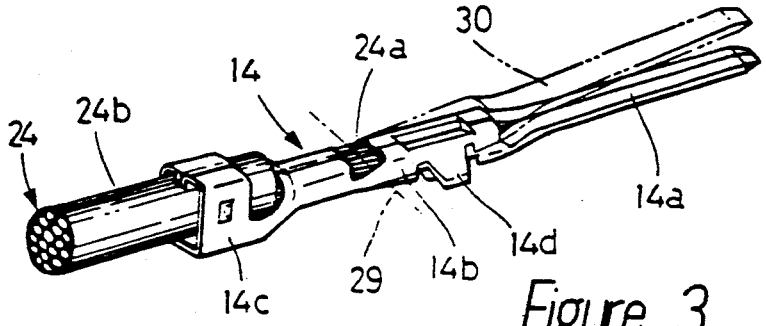
FIG. 3 is a perspective view of a tab contact.

As shown in FIG. 3 and described hereinbefore, electrical connection to stripped portion 24*a* of electric wire 24 is made by crimping it at crimping-connection section 14*a* of each tab contact 14. Such crimping connection is made using a conventional crimping tool. The tab contact 14 tends to be bent up at the front portion 30 starting at section 29 and including tab section 14*a*, as shown in phantom in FIG. 3, when such crimping connection is performed.

Figure 4:
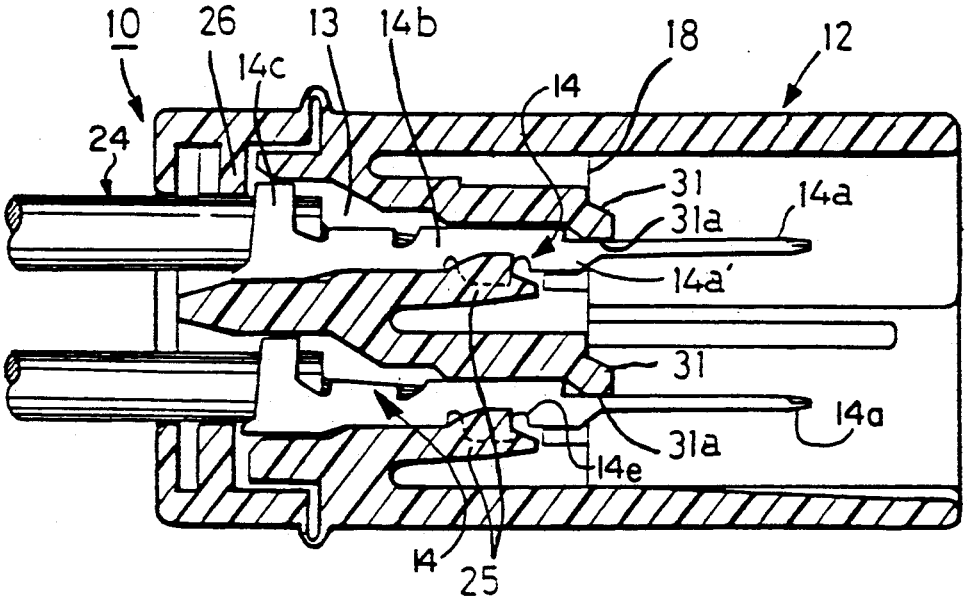
FIG. 4 is a longitudinal cross-sectional view of the tab connector.
Figure 5:
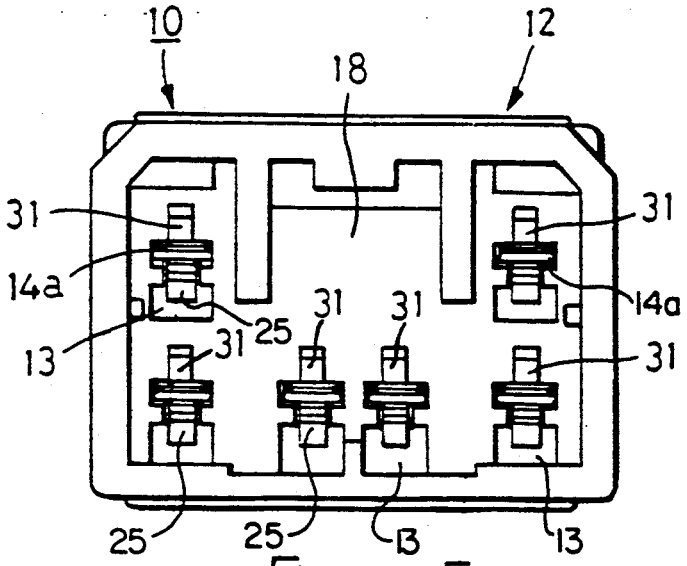
FIG. 5 is a front end view of the tab connector in FIG. 4 as seen from the right.

In the present invention, however, restraining sections 31, as best shown in FIGS. 4 and 5, are formed to extend radially and forwardly from the upper front edges of the walls of cavities 13 and having flat engaging surfaces 31*a* to correct such "bent-up" portions of tab contacts 14 when the tab contacts 14 are to be inserted in cavities 13. As a result, if the front portions 30 of tab contacts 14 are bent up, engaging surfaces 31*a* engage with the upper surfaces of tab sections 14*a* near the base sections to bend them downwards simultaneously with insertion of tab contacts 14 in cavities 13. This will correct bent-up portions of tab sections 14*a* and straighten them; in other words render them essentially perpendicular to vertical front surface 18, thereby allowing corrected tab sections 14*a* to be inserted properly between resilient members 17*a*" and 17"' (see FIG. 2) of receptacle sections 17*a*.

In practice, the length of the radial extension of restraining sections 31 into cavities 13 from the inner surface of cavities 13 is formed to the extent to correct up to about 7 degrees of bent-up portions of tab sections 14*a*. As understood from FIG. 2, resiliency and misaligned ends of members 17*a*" of the present invention enable proper insertion of tab sections 14*a* between members 17*a*" and 17*a*"' even if restraining sections 31 extend slightly excessively to bend the front ends of tab sections 14*a* downwards from the horizontal line or tab sections 14 were already bent slightly down. Furthermore, the provision of restraining sections 31 will reduce the length of the tab sections 14*a* from the front end of cavities 13 to the outer ends as compared with conventional tabs thereby improving the strength of the tab sections 14*a* to preclude rocking or back and forth movement that may be encountered when inserting tab sections 14*a* into receptacle sections 17*a*. Needless to say, the length of the forward extension of restraining sections 31 is chosen so that the front ends of sections 31 do not hit the tops of receptacle sections 17*a* when housings 12, 15 are completely mated with each other.

As understood from the above description, according to the electrical connector of the present invention, any bent-up portions of the tab sections of the tab contacts that may be caused during the crimping operation to electrical wires will be automatically corrected to a straight and proper condition by restraining sections of the housing thereby ensuring proper insertion of the tab sections in receptacle sections of the receptacle contacts without causing tips of the tab sections to strike or override the front ends of the receptacle sections. Simultaneously, the restraining sections protect deformation and damage of both of the tab and receptacle sections.

Also, the electrical connector reduces the free end length of the tab sections retained in the cavities from the front end thereof as compared with that of conventional tab contacts, thereby improving the strength of the tab sections and precluding rocking when the tab sections are inserted in the receptacle sections thereby avoiding deformation near the base portions of the tab sections.

I claim:

1. An electrical connector, comprising:

a dielectric housing having a first section including contact-receiving passageways and a second section defining a mating section for matable engagement with a complementary electrical connector having receptacle contacts secured therein, said second section extending forwardly from a front surface at which front ends of the contact-receiving passageways are located;

tab contacts disposed in said contact-receiving passageways;

securing means provided by said housing and said tab contacts whereby said tab contacts are secured in said contact-receiving passageways;

tab sections of said tab contacts extending beyond said front surface and along said mating section; and restraining sections on said front surface adjacent the front ends of the contact-receiving passageways and extending in a radial direction of said contact-receiving passageways for engaging along top surfaces of said tab sections adjacent the base portions thereof thereby aligning the tab sections for matable engagement with the receptacle contacts when said mating section matably engages the complementary electrical connector.

2. An electrical connector as claimed in claim 1, wherein said securing means comprises housing lances in said contact-receiving passageways engaging shoulders of said tab contacts.

3. An electrical connector as claimed in claim 1, wherein said securing means comprises back sections of said housing having projections engaging rear sections of said tab contacts.

* * * * *